United States Patent [19]

Thorogood

[11] Patent Number: 4,715,165

[45] Date of Patent: Dec. 29, 1987

[54] METHOD AND APPARATUS FOR REMOVAL OF ITEMS FROM A STERILE ENCLOSURE

[75] Inventor: Douglas E. Thorogood, Tervuren, Belgium

[73] Assignee: Baxter Travenol Laboratories, Inc., Deerfield, Ill.

[21] Appl. No.: 32,912

[22] Filed: Apr. 1, 1987

Related U.S. Application Data

[63] Continuation of Ser. No. 806,075, Dec. 5, 1985, abandoned.

[51] Int. Cl.[4] ..... B65B 5/00

[52] U.S. Cl. ..... 53/469; 53/576

[58] Field of Search ..... 53/469, 479, 567, 568, 53/576, 167, 425, 426, 450, 548, 550, 577

[56] References Cited

U.S. PATENT DOCUMENTS

| | | | |
|---|---|---|---|
| 1,607,846 | 11/1926 | Potter | 53/576 X |
| 3,726,060 | 4/1973 | McMillan | 53/576 X |
| 4,358,873 | 11/1982 | Kollross | 17/41 X |
| 4,430,772 | 2/1984 | Michel et al. | 53/576 X |
| 4,480,426 | 11/1984 | Wach et al. | 53/567 X |
| 4,493,179 | 1/1985 | Brak | 53/567 X |
| 4,590,748 | 5/1986 | Harrison et al. | 53/576 |

FOREIGN PATENT DOCUMENTS

| | | | |
|---|---|---|---|
| 2309089 | 8/1973 | Fed. Rep. of Germany | 53/576 |

*Primary Examiner*—Robert L. Spruill
*Assistant Examiner*—Steven P. Weihrouch
*Attorney, Agent, or Firm*—Mary R. Jankousky; Robert M. Barrett; Paul C. Flattery

[57] ABSTRACT

A length of flexible packaging is provided for use with a sterile enclosure or isolator. The packaging is attached to a port on the outside of the sterile isolator and is adapted to enable an item to be passed from the interior of the sterile isolator through the port into the interior of the packaging. A transverse seal is made in the packaging to seal the dangerous chemical in a segment of the packaging. The packaging is cut transversely along the sealed section and the segment containing the item is separated from the packaging.

3 Claims, 6 Drawing Figures

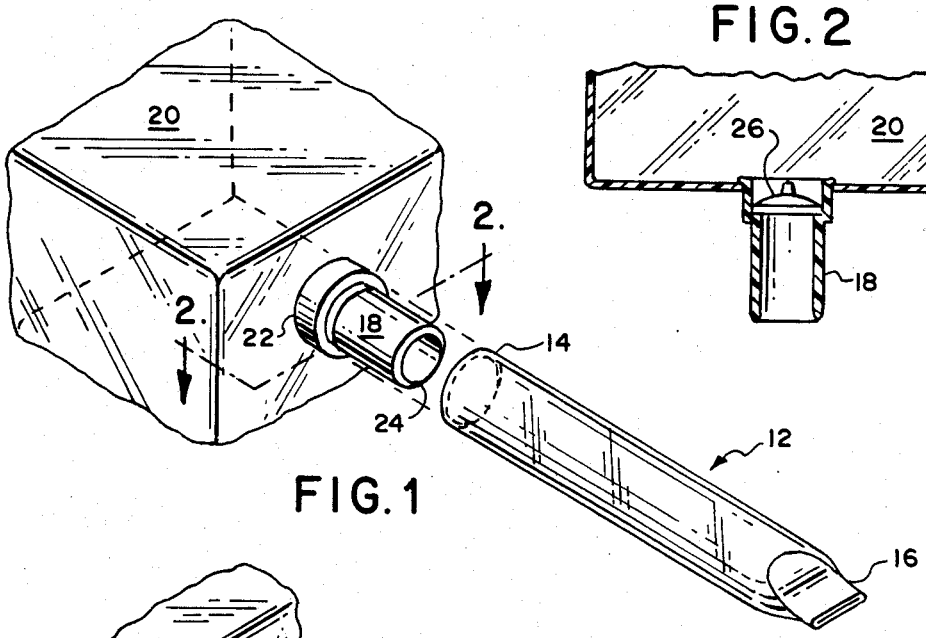
FIG. 1
FIG. 2
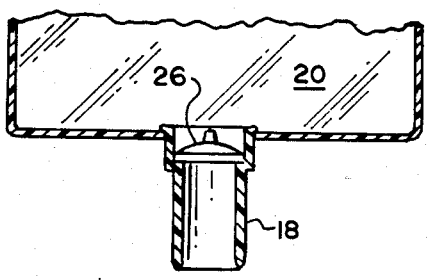
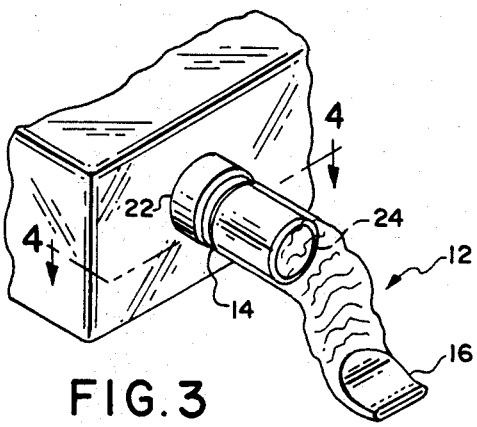
FIG. 3
FIG. 4
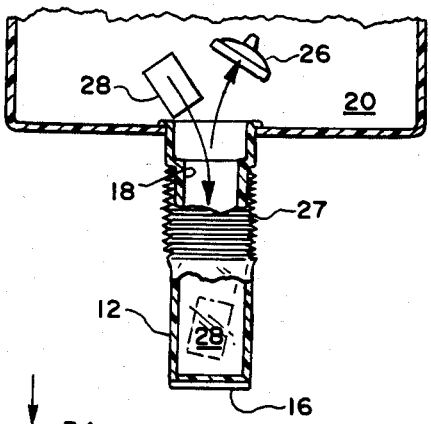
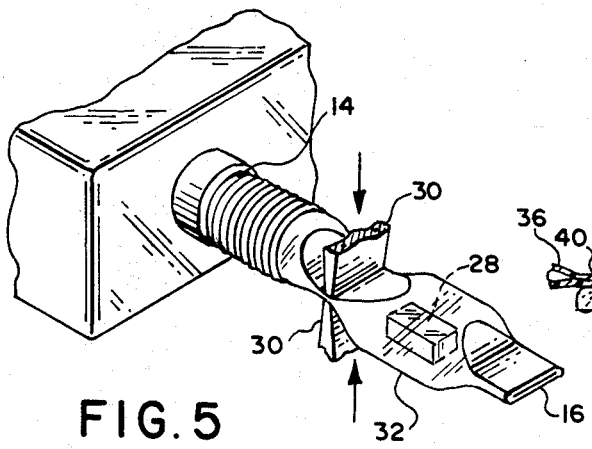
FIG. 5
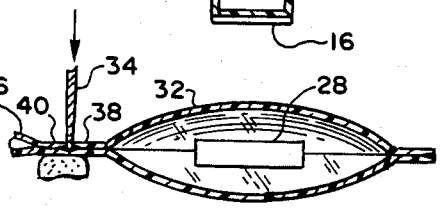
FIG. 6

METHOD AND APPARATUS FOR REMOVAL OF ITEMS FROM A STERILE ENCLOSURE

This application is a continuation of application Ser. No. 806,075 filed Dec. 5, 1985 now abandoned.

The present invention relates to a method and apparatus for removal of items from a sterile enclosure. For example, the present invention relates to a method and apparatus for the removal and packaging of dangerous chemicals, such as toxic drugs, from a sterile enclosure, such as a sterile isolator typically found in a hospital pharmacy and used for the compounding of drugs.

It is an object of the present invention to allow the removal of items from a sterile enclosure without loss of sterility in the sterile enclosure.

It is another object of the present invention to allow dangerous chemicals to be removed from a sterile enclosure or sterile isolator without loss of sterility in reference to the chemicals or in reference to the isolator and in a manner which protects personnel who are handling the chemicals.

It is another object of the present invention to avoid allowing drops of the dangerous chemical or drug to come in contact with the skin of personnel handling the dangerous chemicals.

Medical treatment of the patients sometimes requires the use of drugs which are dangerous or toxic. Sometimes such drugs must be administered intravenously to the patient in a hospital. The drugs must be maintained in a sterile condition. Prior to administration, the drugs sometimes must be diluted, compounded or reconstituted, that is, the drugs must be mixed with a diluent solution. Various designs of sterile enclosures, sometimes known as sterile isolators, are available. Such enclosures provide a sterile environment in which drugs can be mixed, compounded or otherwise handled without damaging the sterile condition of the drugs. Maintaining sterility is important, especially where the drug and the diluent, after compounding, are injected into the vein of a patient as part of intravenous therapy. In some cases, such as for patients suffering from a form of cancer, the drug is toxic. For such toxic drugs, it is important that no part of the drug touch or drop on the skin of hospital personnel handling, compounding or reconstituting the drug. Even a small drop of such a drug, especially in concentrated form, on the skin of hospital personnel would be dangerous to the personnel.

SUMMARY OF THE INVENTION

The present invention is directed to a method and apparatus for maintaining sterility and protecting personnel during the removal of items from a sterile enclosure, such as a sterile isolator. The sterile enclosure has a port which leads from the interior of the sterile enclosure to the outside environment. The method includes the step of providing a length of flexible packaging having an open proximal end, a closed distal end and, preferably, a sterile interior. The method also includes attaching the proximal end of the packaging to the port of the enclosure on the outside of the enclosure adjacent to the proximal end of the port. The method also includes compressing the length of packaging and moving a substantial portion of the packaging, including the distal end of the packaging, adjacent to the distal end of the port. The method also includes passing the item from the interior of the sterile enclosure, through the port, into the interior of the packaging adjacent to the distal end of the packaging. The method also includes sealing a substantially transverse area of the packaging at a location adjacent the position of the item at the distal end of the packaging and between the distal end of the packaging and the proximal end of the packaging. As a result, the item is sealed in a segment of the packaging at the distal end of the packaging. The method also includes cutting the packaging substantially transversely along the sealed area so that the item in the sealed segment of the sterile packaging is separated from the remaining length of sterile packaging. The apparatus comprises a length of flexible packaging having an open proximal end, a closed distal end and a sterile interior. The proximal end is adapted to be attached to the port of the enclosure on the outside of the enclosure. The length of packaging is adapted to be compressed longitudinally on the port of the enclosure. As a result, a substantial length of the packaging, including the distal end of the packaging, is positioned adjacent to the port. The item may be passed from the sterile enclosure into the packaging adjacent to the distal end of the packaging. A section of the packaging may be sealed at a point between the position of the item at the distal end and the proximal end and the item in the sealed segment may be cut off from the remaining packaging.

DESCRIPTION OF THE DRAWINGS

FIG. 1 is an isometric view of the preferred embodiment of the method and apparatus of the present invention, including an example of the packaging of the present invention and an example of a sterile enclosure with which the packaging is used.

FIG. 2 is a cross-section of FIG. 1 along the lines 2—2.

FIG. 3 is an isometric view showing the packaging of FIG. 1 mounted on the port of the sterile enclosure shown in FIG. 1.

FIG. 4 is a cross-sectional view of FIG. 3 along the lines 4—4.

FIG. 5 is an isometric view of the packaging after an item has been passed from the sterile enclosure into the packaging.

FIG. 6 is a cross-sectional view of a portion of FIG. 5 showing the step of cutting a segment of the packaging after sealing.

DESCRIPTION OF THE PREFERRED EMBODIMENT

Referring to FIG. 1, a length of flexible packaging 12 is provided. The packaging 12 has an open proximal end 14, a closed distal end 16 and, preferably, a sterile interior. The packaging 12 is adapted to be mounted on a port 18 of a sterile enclosure. In this embodiment, the sterile enclosure is a sterile isolator 20 sometimes used in a hospital pharmacy. Many different types and shapes of sterile isolators are in use. Some sterile isolators are quite small. Others are quite large. A large sterile isolator permits a human being to stand, at least partially, in the sterile isolator. The port 18 leads from the interior of the sterile isolator 20 to the outside environment. The port 18 has a proximal end 22 adjacent to the interior of the isolator 20 and a distal end 24 outside of the isolator 20. The port 18 includes a segment which in this embodiment is cylindrical and is about 12 inches to 24 inches long and about 12 inches to 18 inches in diameter.

Other packaging within the scope of the present invention may be of a different shape, that is, a shape adapted for the shape of the port of particular sterile enclosure or insulator with which the packaging is intended to be used. The packaging in this embodiment is cylindrical in shape because it is adapted to be fitted over a cylindrical port 18.

Referring to FIG. 2, the port 18 may have a hatch 26 adapted to be closed or opened to open the passageway through the port 18 between the interior of the sterile isolator 20 and the outside environment.

Referring to FIG. 3, the proximal end 14 of the packaging 12 is attached to the port 18 on the outside of the isolator 20 adjacent to the proximal end 22 of the port 18. The packaging is made of a flexible material, such as a flexible plastic. Referring to FIG. 4, the packaging 12 is adapted to be compressed longitudinally, such as with accordian-like pleats 27, so that a substantial portion of the length of the packaging 12 can be moved over and around the port 18. Thus, the remaining portion of the packaging 12 including the distal end 16 of the packaging 12 is moved adjacent to the distal end 24 of the port 18.

Referring to FIG. 4, in use, after the packaging 12 has been mounted on the port 18, the hatch 26 is opened. In this embodiment, the item to be removed is a dangerous chemical 28, such as a cytotoxic drug, which has been compounded within the sterile isolator 20. The dangerous chemical 28 is passed from the interior of the sterile isolator 20 through the port 18 into the interior of the packaging 12 adjacent to the distal end 16 of the packaging 12. The dangerous chemical 28 may be a cytotoxic drug which has been compounded into a diluent solution in a small plastic bag, such as a Mini-Bag TM container marketed by Travenol Laboratories, Inc. of Deerfield, Ill., U.S.A. The item may also be remnants after the compounding process within the sterile isolator 20. For example, the remnant may be the drug vial from which the concentrated drug was removed in order to inject the concentrated drug into the Mini-Bag container. The remnants of the dangerous drug in the vial must be discarded. Such remnants may also be passed through the port 18 into the interior of the packaging 12 adjacent to the distal end 16 of the packaging 12.

Referring to FIG. 5, after the dangerous chemical 28 is inside the packaging 12 adjacent to the distal end 16 of the packaging 12, a substantially transverse area of the packaging 12 is sealed by a sealing means 30 at a location adjacent the position of the dangerous chemical 28 and between the distal end 16 of the packaging and the proximal end 14 of the packaging 12. As a result, the dangerous chemical 28 is sealed in a segment 32 of the packaging 12 at the distal end 16 of the packaging.

Referring to FIG. 6, the packaging 12 is cut substantially transversely by a cutting means 34 along the sealed area. As a result, the dangerous chemical 28 in the sealed segment 32 of the packaging is separated from the remaining length 36 of packaging 12. Referring to FIGS. 5 and 6, the portion 40 of the sealed area which lies on the remaining length of packaging 12 forms the distal end 16 of the packaging. As a result, the remaining packaging can be used again for additional items of dangerous chemicals 28.

Referring to FIGS. 5 and 6, the step of sealing the substantially transverse area of the packaging 12 is preferably accomplished by a sealed area which is wide enough so that when the packaging 12 is cut transversely along the sealed area, a portion 38 of the sealed area lies on the separated segment 32 of packaging and another portion 40 of the sealed area lies on the remaining length of packaging 12. The step of cutting the packaging substantially transversely along the sealed area may preferably include the step of cutting the sealed area at approximately the midpoint of the sealed area whereby a portion 38 of the sealed area lies on the separated segment 32 and another portion 40 of the sealed area lies on the remaining length of packaging 12.

Referring to FIG. 6, the dangerous chemical 28, such as a cytotoxic drug, in the sealed segment 32 may be a Mini-Bag container or other container which has the drug in diluted form. If so, the separated segment 32 may be sent to the ward of the hospital where the drug can be administered to a patient. During transport from the area of the sterile enclosure, such as a sterile isolator 20, to the patient in another part of the hospital, hospital personnel are protected as they handle the dangerous chemical 28 because the dangerous chemical 28 is in the segment 32 of packaging 12. Having the dangerous chemical 28 within the segment 32 of the packaging 12 lowers the risk to hospital personnel handling the dangerous chemical. For example, it lowers the risk that a drop of the dangerous drug, even in diluted form, may get on the skin of hospital personnel or be released into the atmosphere of the hospital. Similarly, if the dangerous chemical 28 illustrated in FIG. 6 is a remnant from the compounding process, such as a partially empty drug vial, the drug vial is contained within another, and different, segment 32 of packaging 12. For the same reasons, hospital personnel are protected in handling such remnants. By this invention, the remnants may be discarded in a more safe manner.

The invention is not intended to be limited to the particular shape of sterile packaging illustrated in FIGS. 1–6. The packaging 12 may be of a different size and shape according the port of the sterile enclosure, or sterile isolator, with which the sterile packaging is intended to be used. The packaging may be manufactured and supplied as a roll of material. The packaging may be supplied in a sterile condition. In the alternative, the packaging may be sterilized after it is mounted on the port 18, as illustrated in FIG. 3.

I claim:

1. A method for maintaining sterility of a sterile item during the removal of the sterile item from a sterile enclosure having a port which leads from the interior of the sterile enclosure to the outside environment, the port having a proximal end adjacent to the interior of the enclosure and a distal end outside of the enclosure and the sterile enclosure including means for closing the port to provide a closed sterile environment, the method comprising the steps of:

(a) providing a length of flexible packaging having an open proximal end, a closed distal end and a sterile interior;

(b) attaching the proximal end of the packaging to the port of the enclosure on the outside of the enclosure and adjacent to the proximal end of the port;

(c) compressing the length of packaging and moving a substantial portion of the packaging including the distal end of the packaging adjacent to the distal end of the port;

(d) opening the means for closing the port to define a closed sterile environment comprising the sterile enclosure and sterile interior of the sterile length of packing;

(e) passing the sterile item from the interior of the sterile enclosure through the port into the interior of the packaging adjacent to the distal end of the packaging;

(f) sealing a substantially transverse area of the packaging at a location between the position of the sterile item at the distal end of the packaging and the proximal end of the packaging, whereby the sterile item is sealed in a segment of the packaging at the distal end of the packaging;

(g) cutting the packaging substantially transversely along the sealed area whereby the sterile item in the sealed segment of the packaging is separated from the remaining length of packaging; and wherein (h) the step of sealing a substantially transverse area of the packaging comprises making the sealed area wide enough whereby, when the packaging is cut substantially transversely along the sealed area, a portion of the sealed area lies on the separated segment of packaging and another portion of the sealed area lies on the remaining length of packaging, the sterile enclosure and sterile interior of the remaining length of packaging defining a closed sterile environment.

2. The method for maintaining sterility according to claim 1 wherein the step of cutting the packaging substantially transversely along the sealed area further comprises the step of cutting the sealed area at approximately the mid-point of the sealed area whereby a portion of the sealed area lies on the separated segment and another portion of the sealed area lies on the remaining length of packaging.

3. A sterile isolator including a sterile enclosure, the enclosure having a port for access between the interior of the sterile enclosure and the outside environment and means for closing the port to provide a closed sterile environment, the sterile isolator further comprising:

(a) a length of flexible packaging material having an open proximal end, a closed distal end and a sterile interior;

(b) the proximal end of the packaging adapted to be attached to the port of the enclosure on the outside of the enclosure;

(c) the length of packaging material being adapted to be compressed longitudinally on the port of the enclosure whereby a substantial length of packaging including the distal end of the packaging is positioned adjacent to the port, the sterile enclosure and sterile interior of the packaging material defining a closed sterile environment when the means for closing the port is open, whereby a sterile item may be passed from the sterile enclosure into the packaging adjacent to the distal end of the packaging;

(d) means for sealing a section of packaging at a location between the position of the sterile item at the distal end of the packaging and the proximal end of the packaging whereby the sterile item is sealed in a segment of the packaging at the distal end of the packaging;

(e) means for cutting the sealed section of packaging to separate the sterile item in the sealed segment from the remaining portion of packaging; and (f) said sealed section of packaging comprising a sealed area wide enough whereby, when the packaging is cut along the sealed area, said separated section of the packaging includes a portion of the sealed area and said remaining portion of the packaging includes a portion of the sealed area, whereby the remaining portion of packaging can be used for additional items and the sterile enclosure and sterile interior of the remaining portion of the packaging defines a closed sterile environment.

* * * * *